United States Patent [19]

Clifford

[11] 4,218,803

[45] Aug. 26, 1980

[54] IMPLEMENT FOR CLEANING TUBULAR CULVERTS

[76] Inventor: Jack R. Clifford, 1817 State Street, Alton, Ill. 62202

[21] Appl. No.: 42,548

[22] Filed: May 25, 1979

[51] Int. Cl.[3] ..... B08B 9/02

[52] U.S. Cl. ..... 15/104.3 R

[58] Field of Search ..... 15/104.3 R

[56] References Cited

U.S. PATENT DOCUMENTS 1,132,691 3/1915 Sieben ..... 15/104.3 R X 1,344,249 6/1920 Stewart ..... 15/104.3 R

*Primary Examiner*—Edward L. Roberts

*Attorney, Agent, or Firm*—Grace J. Fishel

[57] ABSTRACT

An implement for cleaning storm sewers and culverts having a tubular configuration has a carriage assembly with radially extending cutting means at a forward end and a corresponding radially extending plunger means in spaced relationship therewith at a rearward end, together with means for wetting dirt in the culvert in advance of the cutting means and further means for wetting the dirt in advance of the plunger means.

11 Claims, 12 Drawing Figures

FIG. 2
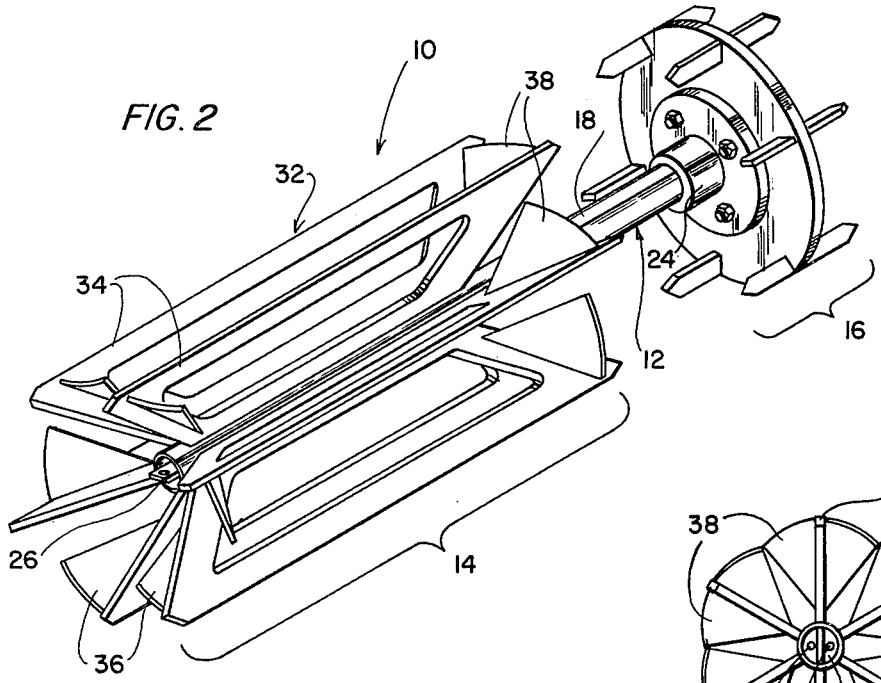
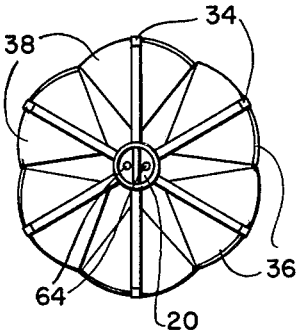
FIG. 3
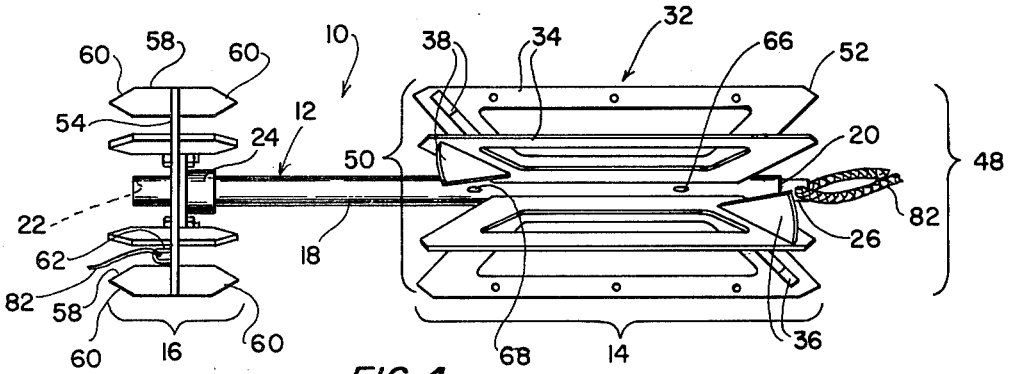
FIG. 4
FIG. 5
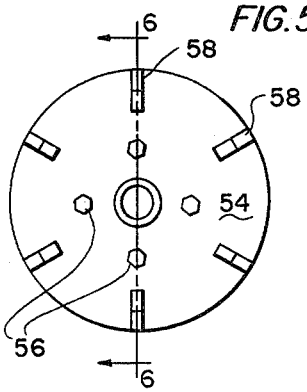
FIG. 6
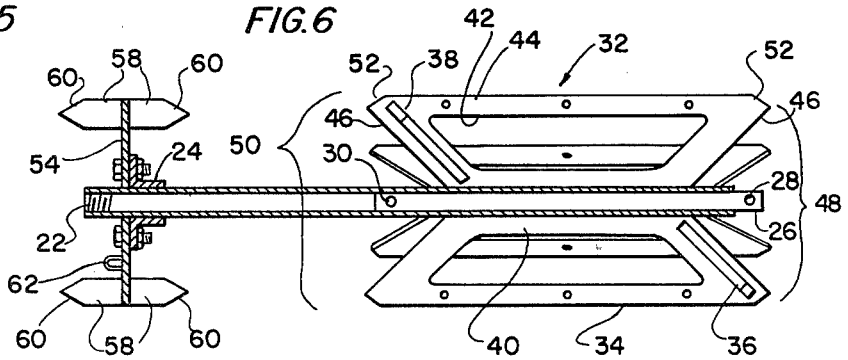

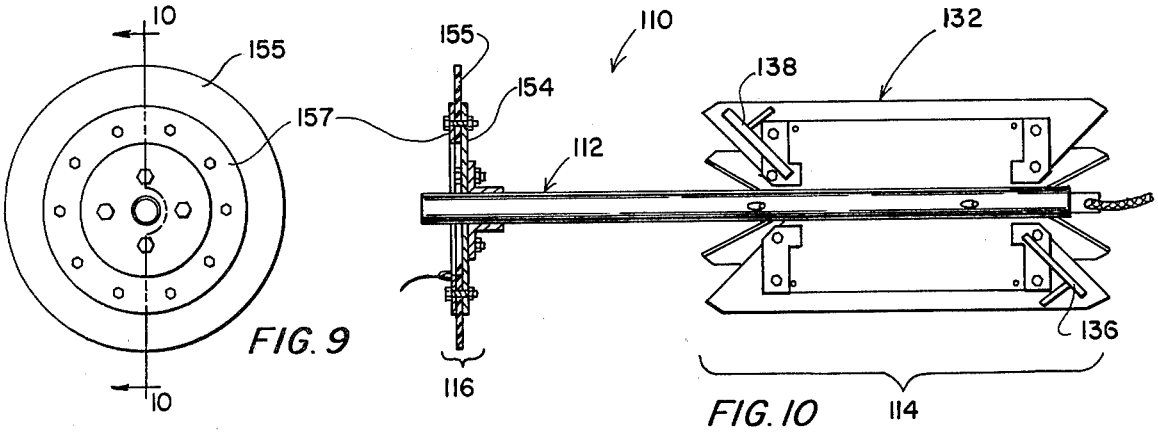
FIG. 9
FIG. 10
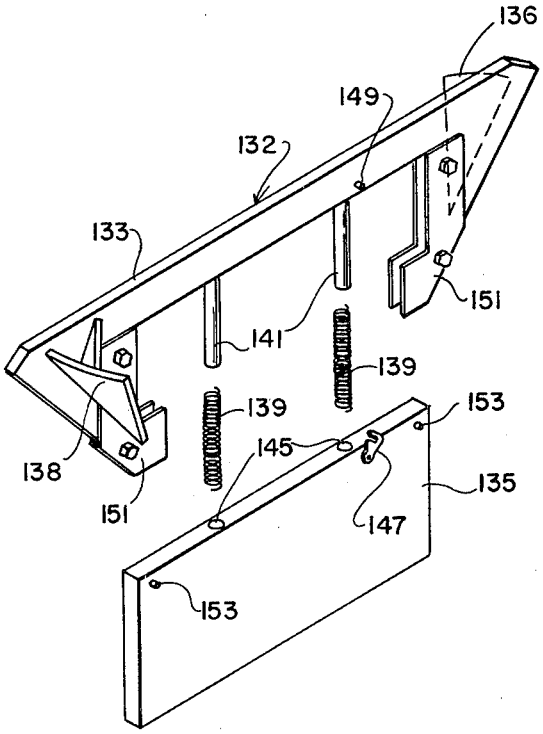
FIG. 11
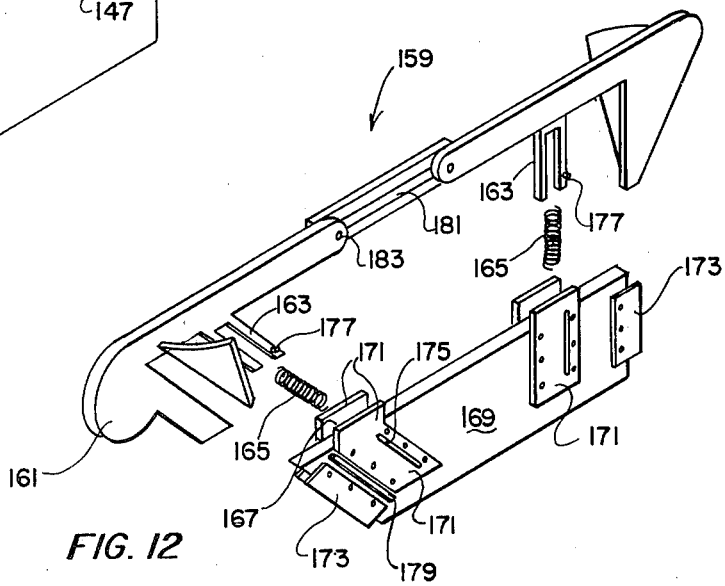
FIG. 12

IMPLEMENT FOR CLEANING TUBULAR CULVERTS

This invention relates to an implement for cleaning storm sewers and culverts having a tubular configuration.

Many storm sewers and culverts under roadways and other embankments are too small for a man to crawl inside. Such waterways, particularly when they are small, frequently become filled in time with silt or clay intermixed with trash, rocks, tree limbs and other debris. Usually they are not allowed to become completely plugged before they are cleaned since storm water begins to pond up behind the embankment and this draws attention to the problem.

To this day, small storm sewers and culverts are cleaned by hand. The dirt is first spaded or scraped out of the ends of the culvert and the remainder is then flushed out with water. Whatever cannot be reached or washed loose promotes plugging up the culvert again.

In view of the above, there is a need for an implement for cleaning storm sewers and culverts. Such an implement would preferably be adjustable to fit a range of different sized culverts and, additionally, would automatically ride over obstructions without hanging up. Therefore, among the several objects of the present invention may be noted the provision of an implement which in at least one embodiment has all of the above-mentioned capabilities. Other objects and features will be in part apparent and in part pointed out hereinafter.

The invention accordingly comprises the constructions hereinafter described, the scope of the invention being indicated by the subjoined claims. In the accompanying drawings, in which several of various possible embodiments of the invention are illustrated, corresponding reference numerals refer to corresponding parts and in which:

FIG. 2 is a front perspective view of said implement having a cupped cutting means at its forward end and a drag plate at its rearward end;

FIG. 3 is a front view thereof;

FIG. 4 is a side elevation thereof;

FIG. 5 is a rear view thereof;

FIG. 6 is a longitudinal cross-sectional view taken along line 6—6 in FIG. 5;

FIG. 9 is a rear view thereof;

FIG. 10 is a longitudinal cross-sectional view taken along line 10—10 in FIG. 9;

FIG. 11 is an exploded perspective view of a second means for radially expanding said implement; and, FIG. 12 is an exploded perspective view of a third means for radially expanding said implement.

Figure 1:
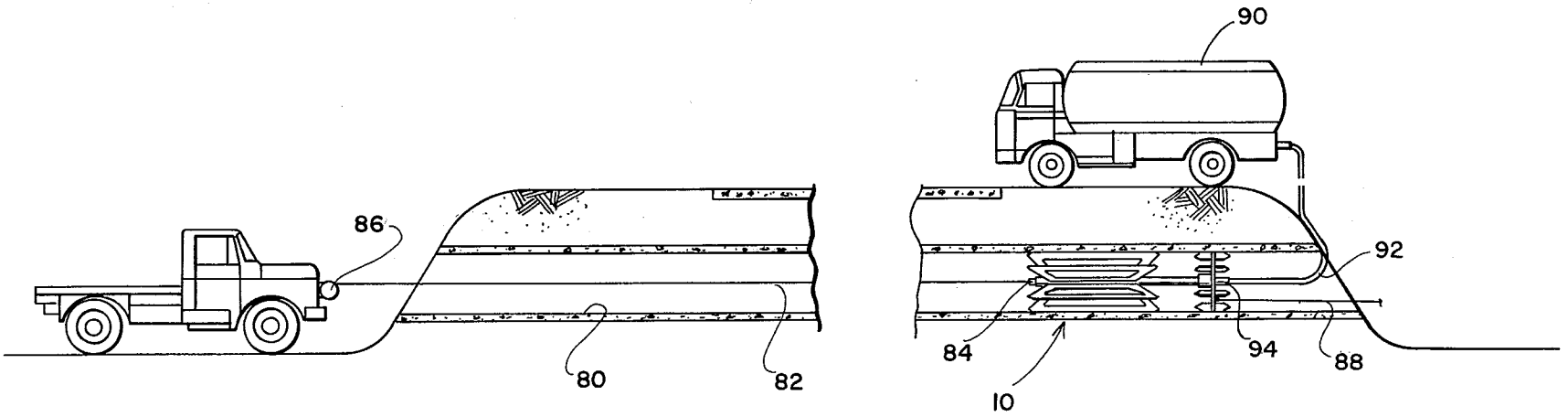
FIG. 1 is a cross-sectional view of a roadway wherein an implement in accordance with the present invention is shown in use.

Referring to the drawings more particularly by reference character, a first implement 10 in accordance with the present invention is shown in FIGS. 1–7 and a modification thereof is shown in FIGS. 8–12. Implement 10 includes a carriage assembly 12 with a cutting means 14 at its forward end and a plunging means 16 in spaced relationship therewith at its rearward end Carriage assembly 12 includes a hollow pipe 18 which is capped at one end 20 and is threaded at its opposite end 22 for attachment to a hose coupling. It further includes a pipe flange 24 for attaching plunging means 16 and a tow bar 26 with holes 28 and 30 adjacent opposite ends. Tow bar 26 extends through end cap 20. It is hooked at 28 to a swivel and is bolted at 30 within pipe 18 to effect transfer of the pulling force from the capped end of pipe 18 to carriage assembly 12 back of cutting means 14.

As illustrated in the drawings, cutting means 14 is made up of six radially projecting cutter blade assemblies 32 which are equally spaced around the outside of pipe 18 and are mounted paralled to the longitudinal axis thereof. Each cutter blade assembly includes a blade 34 and front and rear baffle plates 36 and 38, respectively. In the embodiment shown in FIGS. 1–7, each of blades 34 is formed from a trapezoidal plate which is welded along its shorter parallel side 40 to pipe 18 adjacent capped end 20. A trapezoidal aperture 42 is symmetrically formed in each of blades 34 for use as described below.

When implement 10 is dragged through a culvert, longer parallel sides 44 of blades 34 serve as runners. Nonparallel sides 46 form a pair of oppositely directed, cupped cutting edges 48 and 50 on the forward and rearward end of cutting means 14, respectively. So configured, cutting means 14 is symmetrical front to back. To reduce the possibility of snagging, the leading corners of blades 34 are beveled at 52.

For protection, front and rear baffle plates 36 and 38 are recessed from the side edges of blades 34 such that cupped cutting edges 48 or 50, in the direction of travel, impact debris first. This is important since baffle plates 36 and 38 are at right angles to the direction of travel and more likely to be broken off than blades 34. Baffle plates 36 and 38 are designed to sweep the entire area between the blades. As shown in FIG. 3, they are fan shaped and sized such that the front baffle plate on one blade takes up one-half the area between adjacent blades while the rear baffle plate on the adjacent blade takes up the remaining half. Front and rear baffle plates 36 and 38 are set at opposing radial angles to maximize mixing of the material passing between blades 34. As illustrated, front baffle plate 36 moves the debris in a left hand helix towards the back of the machine while rear baffle plate 38 moves it in a right hand helix towards the front.

Plunging means 16 includes an annular plate 54 which has the same outside diameter as radially projecting cutter blade assemblies 32 and which is bolted at 56 to pipe flange 24. Six double pointed knives 58 are symmetrically arranged at the periphery but within the outer margin of plate 54. As shown, knives 58 are in positional agreement with blades 34 and cooperate with them as runners. Like blades 34, the tips of knives 50 are beveled at 60 to reduce the possibility of snagging. A U-bolt 62 is attached to plate 54 for dragging implement 10 out backwards in the event that it becomes stuck in the waterway being cleaned.

In the form illustrated, end cap 20 includes four forwardly directed waterspouts 64 for spraying water in advance of cutting means 14. Six additional waterspouts 66 are positioned behind and directed at an angle towards front baffle plates 36 while six others are positioned behind rear baffle plates 38 but directed at an angle towards plunging means 16.

Figure 7:
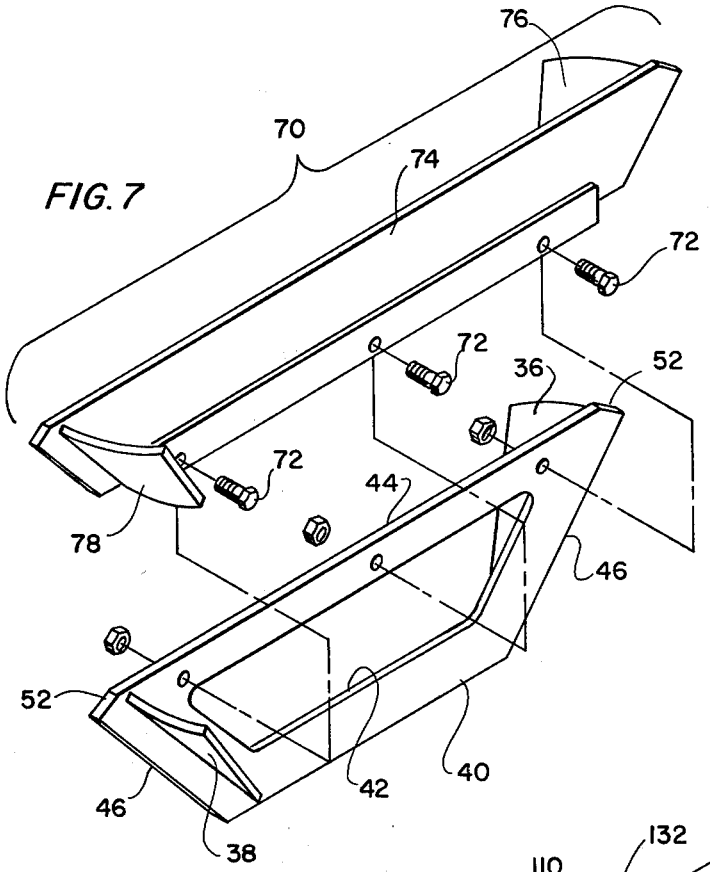
FIG. 7 is an exploded perspective view of one means for radially expanding said implement.
Figure 8:
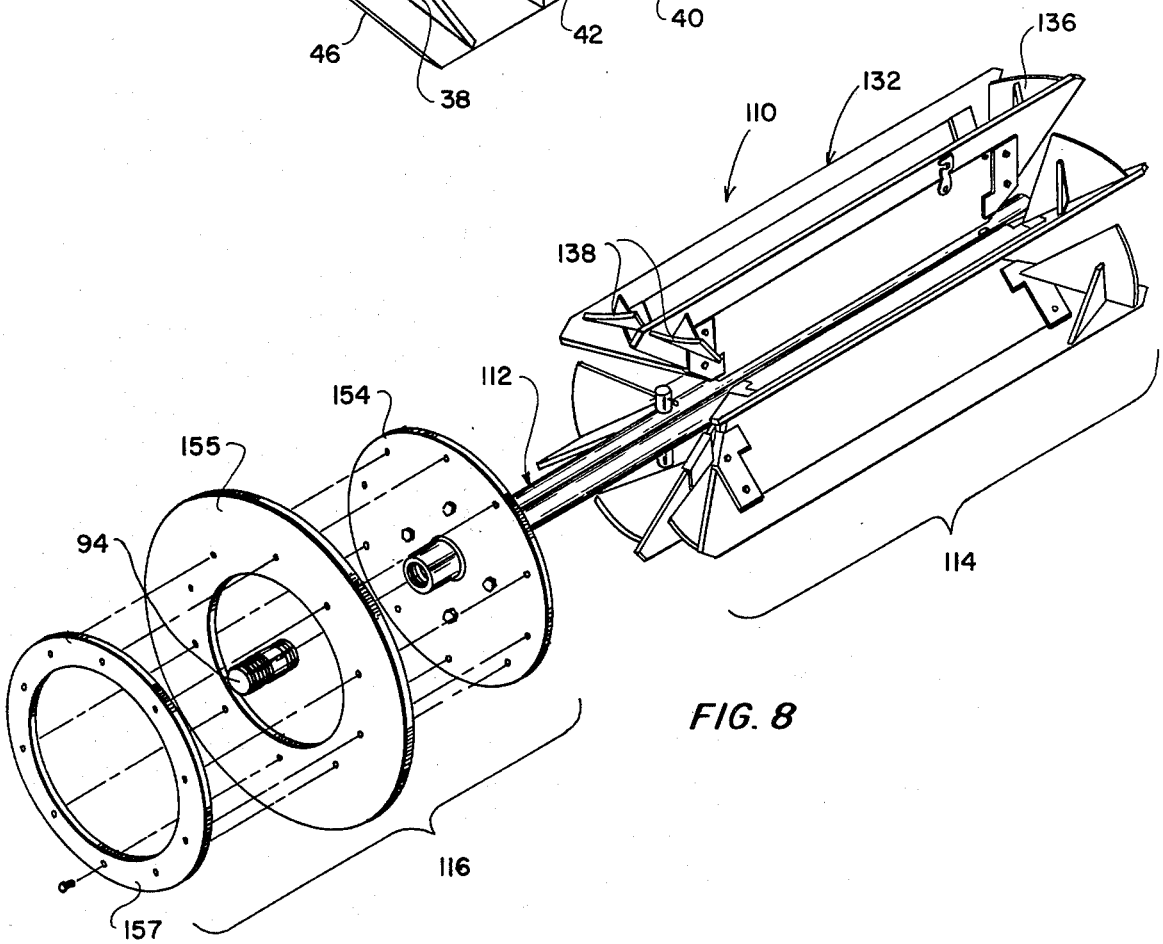
FIG. 8 is an exploded rear perspective view of a second implement made in accordance with the invention.

Implement 10 as shown in FIGS. 1–6 can be radially expanded to fit different sized pipes. For this purpose, a larger annular plate (not shown) can be substituted for annular plate 54 to increase the diameter of plunging means 16. Cutting means 14 is correspondingly expanded by means of auxiliary shoes 70 as shown in FIG. 7. With continuing reference to FIG. 7, it is seen that shoes 70 are designed to slip over runners 44 and be secured thereto by bolts 72. A rail 74 serves as an extension to blade 34 and flanges 76 and 78 serve as extensions to baffle plates 36 and 38.

In use, as shown in FIG. 1, material is cleared by hand from the high end of a stopped up storm sewer or culvert 80. An implement 10 is selected or radially expanded such that it has an outside diameter which fits within close tolerances of culvert 80. It is then put in place with the front of the machine facing the opposite end of the culvert.

A cable 82 for towing implement 10 is attached to a rod (not shown) and is passed through the top of culvert 80. As aforementioned, storm sewers and culverts are seldom allowed to silt full completely and there is almost always an open space at the top of the culvert through which the cable can be threaded. One end of cable 82 is then hooked to a swivel 84 which is pinned to tow bar 26 by hole 28, while the other end of cable 82 is attached to a means for pulling the implement through the culvert such as winch 86. A second cable 88 is attached to U-bolt 62 for dragging the machine out backwards if it becomes lodged in the waterway. A source of water under high pressure such as water truck 90 is attached by means of a flexible hose 92 to implement 10 at a hose coupling 94. A pinon gear (not shown) is inserted between flexible hose 92 and coupling 94 to accommodate any rotation of implement 10 as it goes through the pipe. Thus, the implement is kept from binding or twisting on the hose.

As implement 10 is towed forward by winch 86, it slides on blades 34 and knives 58 which serve as runners. While water is sprayed out of waterspouts 64 in advance of cupped cutting edge 48, the forward rim of said cupped cutting edge scrapes the inner wall of culvert 80 and deflects dislodged material towards forwardly directed waterspounts 64 where it is further wetted with water. Larger items of debris which are not broken up on impact and which are too large to pass between cutter blade assemblies 32 are carried forward with the machine on cupped cutting edge 48.

Dislodged and slightly wetted material is deflected backwardly and radially inwardly by front baffle plates 36. As the material passes around baffle plates 36, it is sprayed with more water by waterspouts 66. It is then directed towards rear baffle plates 38 where it is deflected forwardly and radially inwardly to maximize mixing of the material with the water. Any debris which passes by front baffle plates 36 and which is not deflected by them will be deflected by rear baffle plates 38 since these plates in combination with the front baffle plates sweep the entire area between blades 34.

When the material passes around rear baffle plates 38, it is still further wetted with water from waterspouts 68. The space between cutting means 14 and plunging means 16 serves as a mixing chamber where the silt or debris has time to liquefy. This material then acts as a lubricant on the walls of the culvert and makes the implement surprisingly easy to pull.

As implement 10 is pulled forward, heavier materials, not yet liquified, gravitate towards plunging means 16 while liquified lighter materials are forced towards the front. Trapezoidal apertures 42 in blades 34 permit the lighter more fluid debris to flow around said blades, thus equalizing the pressure and making it easier to squeeze the lighter material out of the culvert as the machine advances.

In those cases where the culvert is badly clogged, the implement can be passed through with annular plate 54 removed. This permits the implement to cut a channel through the debris with a minimum pull force that reducing the possibility that it or the culvert may be damaged. The plate can then be put back on and the machine operated as described above. If the machine becomes stuck in culvert 80, it can be dragged out on cable 88. It is for this reason that cutting means 14 are reversible.

Implement 10 as shown in FIGS. 1–8 is rigid and is useful primarily when culvert 80 is made out of steel or concrete. When the culvert is corrugated or otherwise has a roughened inner surface, a modified implement 110 which is resiliently biased in its radial aspect, as shown in FIGS. 8–12, is preferred since it has better ability to accommodate variations in culvert diameter and ride over seams and other imperfections.

Implement 110, like implement 10, includes a carriage assembly 112 with a cutting means 114 at its forward end and a plunging means 116 at its rearward end in spaced relationship therewith. Cutting means 114 and plunging means 116 differ from their aforementioned counterparts in that they are radially resiliently biased.

As best seen in FIG. 11, cutter blade assemblies 32 are replaced with resiliently biased cutter blade assemblies 132 comprising an open sided frame 133 nested over a plate 135. Each of plates 135 like blades 34, projects radially from the carriage assembly. Frame 133 has an outside configuration like blades 34 with front and rear baffle plates 136 and 138 mounted on opposite sides thereof.

As best seen in FIG. 11, frame 133 is biased by springs 139 on pistons 141 which are received in holes 145 provided therefor in plate 135. A keeper 147 on plate 135 in cooperation with a pin 149 on frame 133 can be used to retain resiliently biased cutter blade assembly 132 in compressed condition. A pair of L-shaped plates 151 are mounted on opposite ends of frame 133 and straddle the side edges of plate 135. Pins 153 in plate 135 cooperate with the toe of plates 151 to limit expansion of frame 133 from plate 135.

Plunging means 116, like cutting means 114, are radially resiliently biased. As shown, a slightly undersized annular plate 154 is bolted to carriage assembly 112. An annular rubber gasket 155 having an outside diameter corresponding to the inside diameter of the culvert is bolted to the back side of plate 154 by means of retaining ring 157. This gasket has the same limited ability to expand and contract like resiliently biased cutting means 114 such that gasket 155 serves as a glide and frames 133 as runners when the machine is towed.

In use, implement 110 is operated in the same way as implement 10 described above except that when implement 110 is inserted into culvert 80, resiliently biased cutter blade assemblies 132 are preferably in compressed condition. Once implement 110 is in place in the mouth of culvert 80, pins 149 are released from keepers 147, preferably starting at the bottom, so that the cutter blade assemblied radially expand to the configuration and diameter of the culvert.

Another radially resiliently biased cutter blade assembly 159 is shown in FIG. 12. This assembly includes a pair of modified J-hooks 161 mounted on pistons 163. Pistons 163 are resiliently biased on springs 165 in channels 167 formed in plates 169 as deep slots covered with shield plates 171. Shield plates 171 extend above plates 169 the thickness of the J-hook received therebetween. The toe of J-hook 161 is received between guide plates 173. A slot 175 and pin 177 arrangement limit the radial expansion of the cutter blade assembly and plates 179 serve as guides. A second slot 181 and pin 183 arrangement link the tops of J-hooks 161 together and compensates for the angled movement of the J-hooks with respect to each other.

In view of the above, it will be seen that the several objects of the invention are achieved and other advantageous results attained. As various changes could be made in the above constructions without departing from the scope of the invention it is intended that all matter contained in the above description or shown in the accompanying drawings shall be interpreted as illustrative and not in a limiting sense.

What is claimed is:

1. An implement for cleaning storm sewers, culverts and other drains and waterways having a tubular configuration, said implement comprising an elongated carriage assembly with means for cutting at its forward end and plunging means at its rearward end in spaced relationship with said cutting means, said cutting means comprising a plurality of blades radially extending from the carriage assembly, said plunging means comprising a plate having substantially the same diameter as said radially extending blades, said implement further including a first water directing means for spraying water in advance of said cutting means and a second water directing means for spraying water behind said cutting means but in advance of said plunging means whereby any dirt clogging the storm sewer or the like is prewetted by said first water directing means before it is cut loose and is further wetted by said second water directing means before it is swept forward by said plunging means.

2. The implement of claim 1 wherein the radially extending blades have leading and trailing ends, said blades mounted on the elongated carriage assembly such that said leading and trailing ends form a cupped cutting surface for scraping the inside walls of the culvert and for directing the dislodged material radially inwardly towards the first water directing means.

3. The implement of claim 2 wherein a pair of oppositely directed, fan shaped baffle plates are mounted on opposite sides of each of the radially extending blades, said baffle plates forming two staggered tiers for deflecting material scraped loose and directed inwardly by the cupped cutting surface in helices of opposite hand to maximize mixing.

4. The implement of claim 3 wherein the second water directing means includes a plurality of waterspouts between said oppositely directed baffle plates, said waterspouts directed at an angle towards the forward tier of baffle plates.

5. The implement of claim 4 wherein the second water directing means includes a second plurality of waterspouts between the plate forming the plunging means and the rearward tier of baffle plates, said second plurality of waterspouts directed at an angle towards said plate forming the plunging means.

6. The implement of claim 5 wherein a plurality of knives are mounted in the margin of the plate forming the plunging means, said knives and said radially extending blades forming runners.

7. The implement of claim 5 wherein the radially extending blades and the plate forming the plunging means are correspondingly radially resiliently biased.

8. The implement of claim 7 wherein the means for resiliently biasing the plate forming the plunging means comprises a rubber ring about the periphery thereof.

9. The implement of claim 8 wherein the radially extending blades include a base and a spring loaded frame which is reciprocated on pistons received in said base.

10. An implement for cleaning storm sewers, culverts and other drains and waterways having a tubular configuration, said implement comprising a carriage assembly with means for cutting at its forward end and plunging means at its rearward end in spaced relationship with said cutting means, said implement further including a first water directing means for spraying water in advance of said cutting means and a second water directing means for spraying water behind said cutting means but in advance of said plunging means whereby any dirt clogging the storm sewer or the like is prewetted by said first water directing means before it is cut loose and is further wetted by said second water directing means before it is swept forwards by said plunging means, and wherein the cutting means include means for scraping the inside walls of the culvert and for directing the dislodged material radially inwardly towards the first water directing means.

11. The implement of claim 10 wherein the cutting means and the plunging means are corresponding radially resiliently biased.

* * * * *